United States Patent [19]

Bassett

[11] Patent Number: 4,960,371

[45] Date of Patent: Oct. 2, 1990

[54] ROTARY COMPRESSOR FOR HEAVY DUTY GAS SERVICES

[76] Inventor: H. Eugene Bassett, 10507 Jody Ct., Houston, Tex. 77099

[21] Appl. No.: 302,974

[22] Filed: Jan. 30, 1989

[51] Int. Cl.[5] ..... F04C 18/344; F04C 29/10

[52] U.S. Cl. ..... 418/13; 418/15; 418/213; 418/268

[58] Field of Search ..... 418/13, 15, 23, 268, 418/213, 178

[56] References Cited

U.S. PATENT DOCUMENTS

| | | | |
|---|---|---|---|
| 819,674 | 5/1906 | Rochow | 418/13 |
| 2,312,886 | 5/1940 | Ellinwood | 418/212 |
| 2,465,595 | 5/1949 | Kratzer | 418/213 |
| 3,547,562 | 12/1970 | Cynor | 418/31 |
| 3,799,707 | 3/1974 | Newton | 418/270 |
| 3,809,511 | 5/1974 | Linder et al. | 418/270 |
| 3,900,277 | 8/1975 | Newton | 418/184 |
| 4,445,830 | 5/1984 | Woodruff | 418/159 |
| 4,451,215 | 5/1984 | Winkler et al. | 418/23 |
| 4,515,513 | 5/1985 | Hayase et al. | 418/270 |
| 4,526,524 | 7/1985 | Kondo et al. | 418/270 |

FOREIGN PATENT DOCUMENTS

| | | | |
|---|---|---|---|
| 169690 | 9/1985 | Japan | 418/259 |
| 1298407 | 3/1987 | U.S.S.R. | 418/15 |
| 19570 | of 1914 | United Kingdom | 418/213 |
| 2188678 | 10/1987 | United Kingdom | 418/23 |

*Primary Examiner*—John J. Vrablik
*Assistant Examiner*—David L. Cavanaugh

[57] ABSTRACT

A rotary gas compressor suitable for heavy duty continuous or intermittent operation with automatic inlet and outlet pressure control valves to reduce power consumption and increase volumetric efficiency. Articulated volume displacers further increase volumetric efficiency, extend life of wearing components and permit infinitely variable capacity control from 0 to 100%. High loads and high speeds are possible due to intrinsic radial load balancing. Additional provisions include replaceable cylinder liners.

11 Claims, 8 Drawing Sheets

ROTARY COMPRESSOR FOR HEAVY DUTY GAS SERVICES

BACKGROUND—FIELD OF INVENTION

This invention relates to rotary compressors, especially to heavy duty air and gas rotary compressors that have heretofore been application limited due to present state of the art.

BACKGROUND—DESCRIPTION OF PRIOR ART

Positive displacement rotary vane type compressors are not well known to the gas production and processing industry, however there are some minimal specialized applications in this industry where they have been applied for many years. Present compressors of this type are usually limited to single stage pressure of approximately 50 psig. Two stage compressors can be applied to 125 psig. Due to inherent design limitations excess power consumption is normal.

Flexibility to optimize performance under varying pressure conditions is virtually nonexistent.

Rotating speed is greatly limited due to inherent imbalance and fragile seal elements (vanes).

Methods to control capacity (flow rate) are limited to inlet throttling and/or recycle valves which result in inefficient use of power.

As a result of these limitations, this type compressor has severe application limitations and for these reasons can not be applied in high power, high pressure and high capacity services.

OBJECTS AND ADVANTAGES

The present invention objective is to address all the requirements for modern heavy duty industrial gas compressors to provide a durable, efficient, flexible and cost effective system with minimal application restrictions.

Accordingly I claim as objects and advantages of the invention enhancements over prior art which individually and/or combined alleviate the restrictions previously mentioned, thereby greatly extending the useful range of rotary compressor applications well into regions historically occupied by reciprocating (piston type) compressors.

Advantages of present invention as compared with reciprocating (piston type) compressors:

A. The advantages of the rotary compressor are small size and weight (10–15%), simplicity (fewer parts), low cost manufacturing, mounting foundations, installation and maintenance. In spite of these advantages, present rotary type compressors are not usually capable of replacing reciprocating type compressors due to the limitations mentioned above.

B. Modern heavy duty reciprocating (piston type) compressors are generally reliable, efficient, have high pressure capabilities and ability to adjust to varying pressure conditions and capacity requirements. A viable rotary compressor considered as a replacement for the reciprocating type compressor must have capabilities equal to or greater than the reciprocating type.

C. In addition, there is an increasing trend toward automation and unattended operation. In this regard, the rotary compressor can be more easily equipped with condition monitoring devices due to its much smaller size, far fewer points requiring monitoring and availability of monitoring devices.

D. There is also an increasing trend to reduce maintenance cost. Here again, the rotary type compressor can help meet these objectives since it has very few moving (wearing) low cost components while the reciprocating type compressor has a much greater number of moving (wearing) relatively high cost components. The time (manpower) required to overhaul the rotary type compressor is a small fraction of that required to overhaul the reciprocating type compressor. In most cases, the rotary type compressor can easily be removed from its foundation and taken to a well equipped shop for overhaul while the massive reciprocating type compressor must usually be overhauled on its foundation, often under extreme weather conditions and by inexperienced personnel.

E. Environmental issues:

1. The rotary compressor according to the present invention makes more effective use of real estate and plant space than a comparable reciprocating compressor.

2. The rotary compressor according to the present invention has greatly reduced noise due to fewer moving parts than a comparable reciprocating compressor.

3. The majority of reciprocating compressors do not have the ability to alter the capacity to exact and often variable process requirements. Those equipped with variable capacity control are either manual handwheel operated or utilize an inefficient pneumatic system that consumes a high amount of power even though the capacity is reduced. Neither of these variable capacity control methods cover wide ranges such as 0 to 100%. The manual handwheel types of capacity control are so cumbersome that they are generally used only in emergency. Due to ineffective capacity control means it is often necessary to send excess compressor capacity to flare or vent it to the atmosphere. The rotary compressor according to the present invention has the capability to provide exact capacity requirements from 0 to 100% thus eliminating the undesirable effects of flaring or venting potentially hazardous gasses while simultaneously conserving power.

As compared to prior art rotary compressors of this general type, I claim the following objects and advantages:

A. Higher pressure capability by a factor of 10 to 20 times.

B. Higher capacity due to possible speed increases of 1.5 to 4 times and greater volumetric efficiency.

C. Flexibility to automatically adjust to varying pressure conditions.

D. Energy efficient infinite capacity control from 0 to 100%.

DETAILED DESCRIPTION OF THE PREFERRED EMBODIMENTS

Figure 1:
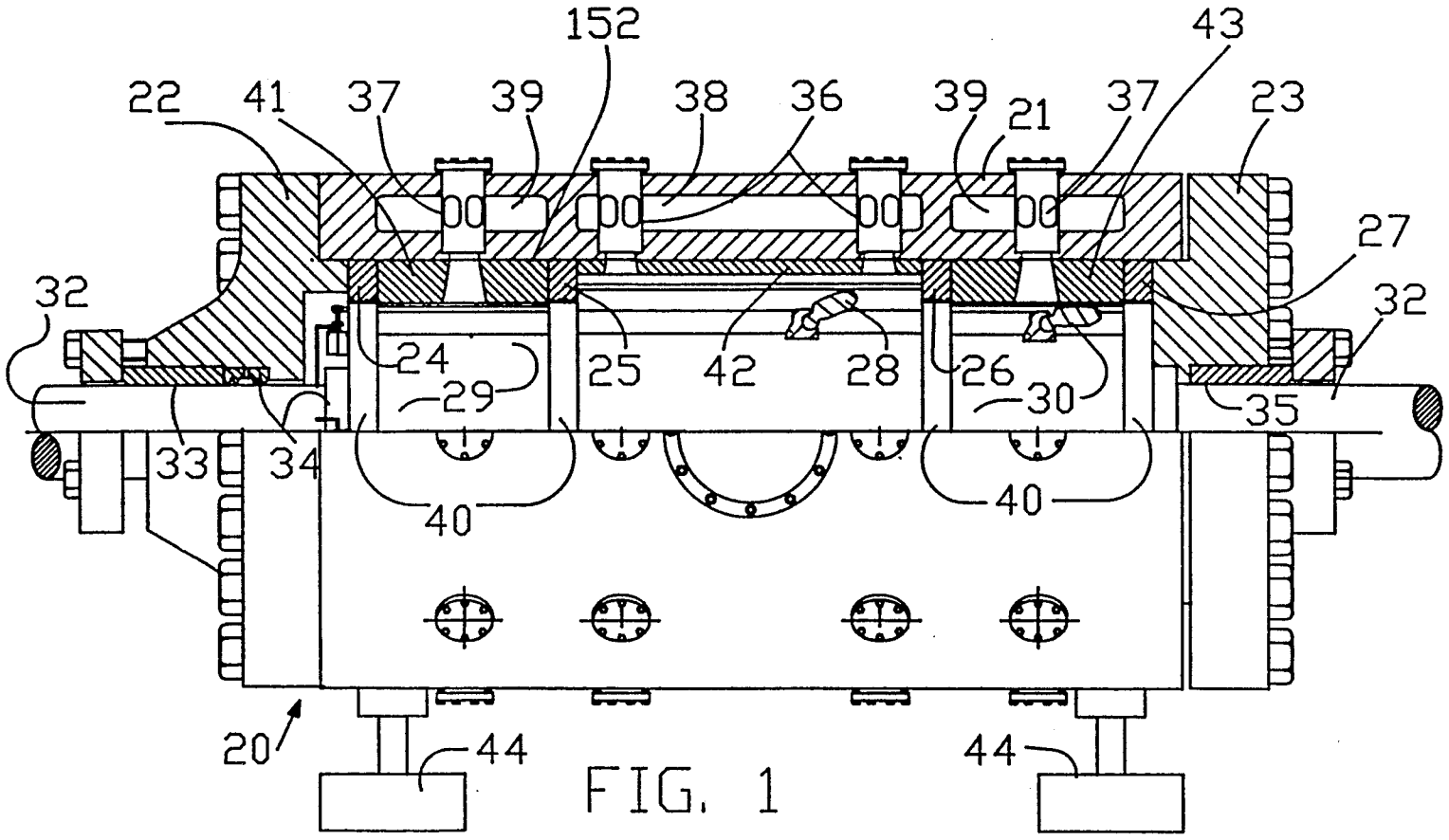
FIG. 1 is a combined side view and longitudinal cross section incorporating all the objects and claims of the present invention.

In the description that follows, similar reference numerals refer to similar elements in all figures of the drawings. Wherever possible the various features of the present invention are illustrated and compared relative to the known prior art.

In FIG. 1 there is shown the preferred embodiment of the rotary compressor according to the present invention. The functions, objects and advantages of the various elements will be explained later. In FIG. 1 the rotary compressor 20 comprises generally a housing member 21, cylinder liner members 41, 42 and 43, end closure members 22 and 23, rotor seal members 24, 25, 26 and 27, rotor members 40, volume displacers 28, 29 and 30, rotor members 32, shaft seal members 33 and 35, capacity control members 34, inlet control valve members 36, outlet control valve members 37, inlet passage members 38, outlet passage members 39, support members 44 and miscellaneous studs, nuts and bolts to retain the various members.

The FIG. 1 working chamber is comprised primarily of a main housing member 21, end closure members 22 and 23, cylinder liner members 41, 42 and 43, and rotor seal members 24, 25, 26 and 27 can be constructed in several configurations including horizontal or vertical split casings with or without the end closures integral with the main housing. Those skilled in the art of rotating machine design will at once recognize and understand the significance and methods pertaining to split casing design.

Figure 2:
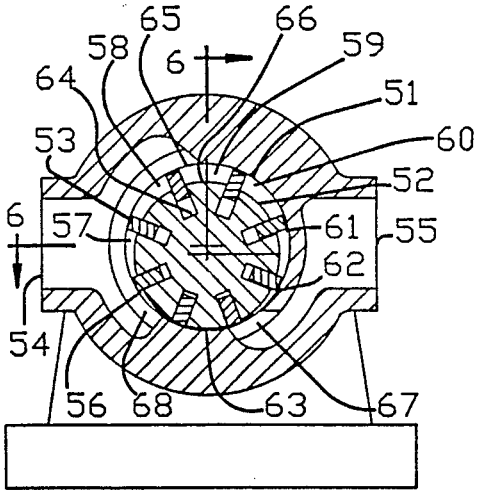
FIG. 2 PRIOR ART
FIG. 2 is a transverse cross sectional view representing the general prior art compressor configuration.
Figure 6:
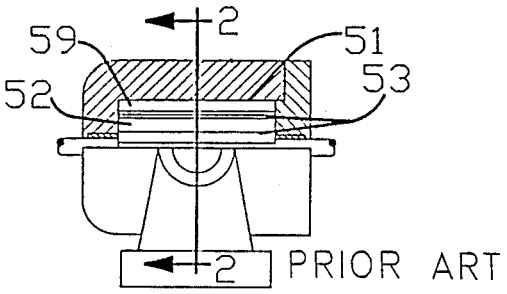
FIG. 6 is a combined side view and longitudinal cross section representing the general prior art configuration.

FIG. 2 and FIG. 6 represent the general rotating compressor prior art configuration which operates as follows:

Rotor 52 is mounted eccentrically within interior surface 51. Radial slots 64 in rotor 52 carry vanes 53 which move outward radially due to centrifugal force as the rotor turns. The outward force causes vanes 53 to contact interior surface 51 thereby forming expansible chambers 56 thru 63. The volume at any expansible chamber position is the space between interior surface 51 and rotor surface 66 bounded by adjacent vanes 53. In other words, the vanes 53 form a series of longitudinal expansible chambers. Incoming gas enters inlet chamber 54 and then enters inlet port 68. Expansible chambers 56 thru 58 and part of 59 are exposed to inlet port 68 and serve only to collect inlet gas. As the rotor turns clockwise beyond expansible chamber position 58, the volume of subsequent expansible chambers constantly change from maximum 59 to minimum 63 depending upon their eccentric position in interior surface 51. As rotor 52 continues clockwise, any point on rotor 52 advances sequentially to expansible chamber position 59, then to expansible chamber position 60 and then to expansible chamber position 61, 62, 63 and then to inlet port 68. During the course of clockwise rotation each subsequent expansible chamber volume diminishes and therefore causes the gas to be compressed as rotor 52 rotates from termination of inlet port 68 and approaches outlet port 67 where the compressed gas enters the outlet passage 55 which is connected to external process piping (not shown).

Figure 4:
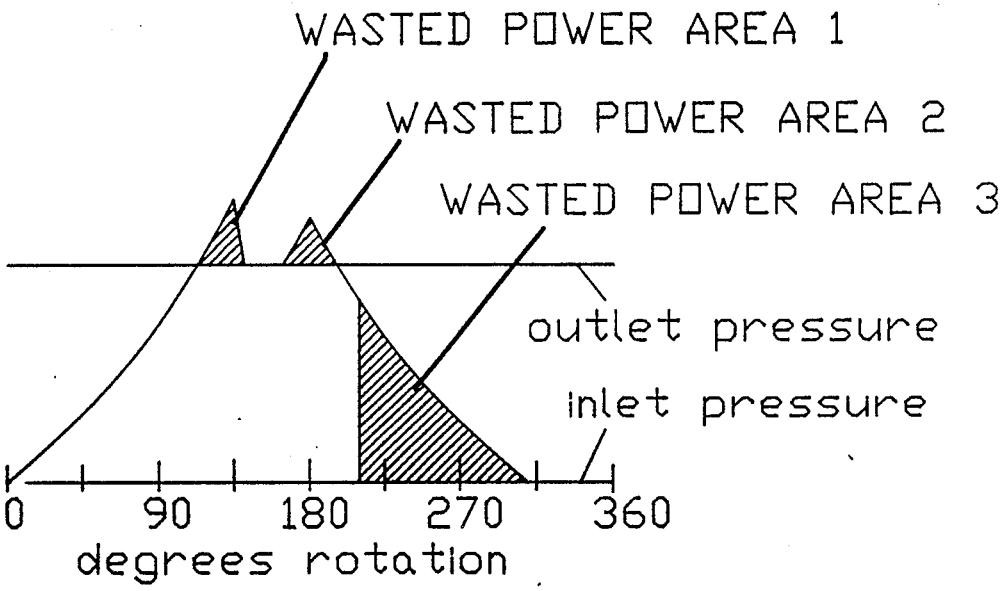
FIG. 4 represents a performance curve for prior art compressor operating near design point.

FIG. 4 illustrates a pressure-position diagram for the prior art compressor. Three cross section areas show "wasted power area". First the gas is compressed from inlet pressure to outlet pressure and then to a higher pressure until any point on rotor 52 has advanced to outlet port 67 where the compressed gas is discharged into outlet passage 55 where it then drops down to the outlet pressure. Compressing gas from one pressure to another requires energy. Any induced pressure above the outlet pressure line is wasted power. This wasted power is denoted "wasted power area 1". As any point on rotor 52 passes and blocks outlet port 67, gas is again compressed by a small amount. This wasted power is denoted "wasted power area 2". At the point of maximum pressure there is still a small amount of volume containing high pressure gas in expansible chamber 63. As rotor 52 moves toward inlet port 68 the trapped gas expands and helps to drive rotor 52 until inlet port 68 is uncovered; at which time there is an abrupt drop of the high pressure gas down to the inlet pressure line. Since this pressure drop is not used for a useful purpose, it is considered wasted power. This wasted power is denoted "wasted power area 3".

Figure 3:
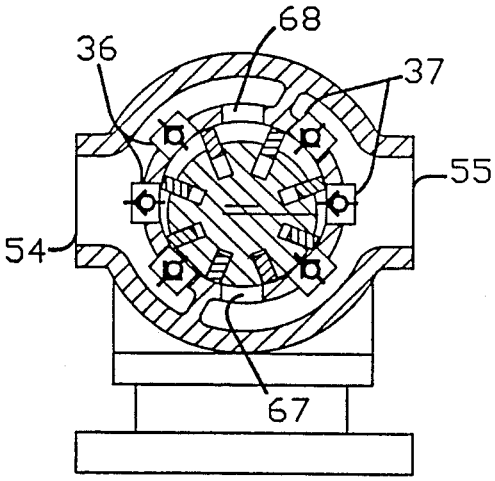
FIG. 3 is a transverse cross sectional view of the general prior art compressor incorporating internal pressure control according to the invention.

FIG. 3 represents another embodiment of the present invention which is essentially same as FIG. 2 and prior art except there has been added a series of inlet control valve members 36 located between outlet port 67 and inlet port 68 and outlet control valve members 37 located between inlet port 68 and outlet port 67. On the compression side, outlet control valve members 37 are of the type that are held closed by pressure in outlet passage 55 until the internal expansible chamber pressure is equal to or slightly above the external pressure; at which time they open and allow flow from the expansible chamber to the outlet passage 55. This prevents creating expansible chamber pressure above the outlet passage 55 pressure which in turn results in reduced driver torque/power. On the inlet side, inlet control valve members 36 are of the type that are held closed by internal expansible chamber pressure until the internal expansible chamber pressure expands down to or slightly below inlet passage 54 pressure. This conserves the trapped high pressure gas to help drive the rotor 52 thru a greater distance thereby further reducing required driver torque power. Inlet control valve members 36 and outlet control valve members 37 are illustrated symbolically as there are a wide variety of commercially available devices that can perform the function. They may be very simple check valves or combination check valves with pilot operators.

Figure 4A:
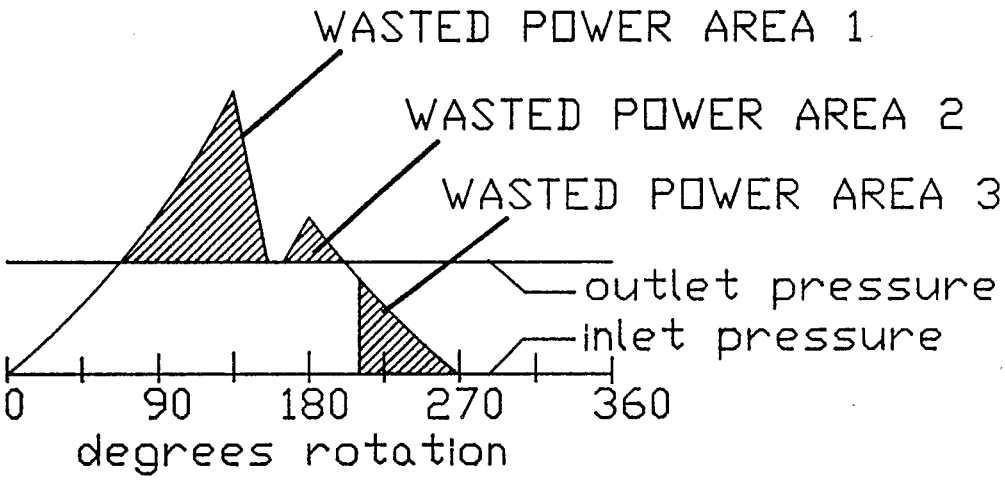
FIG. 4A represents a performance curve for prior art compressor operating at an off-design point.
Figure 5:
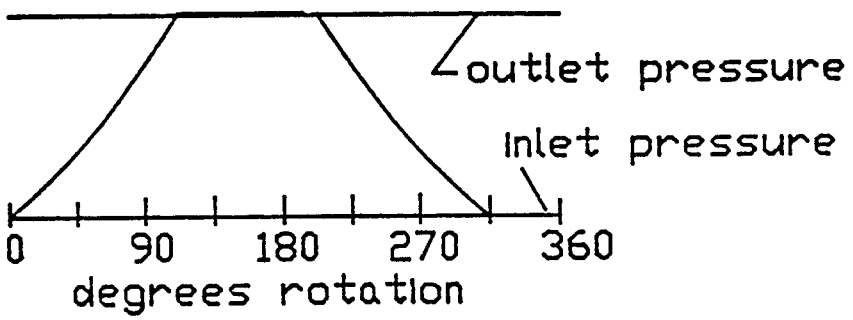
FIG. 5 represents a performance curve for compressor operating near design point with FIG. 3 internal pressure control according to the invention.
Figure 5A:
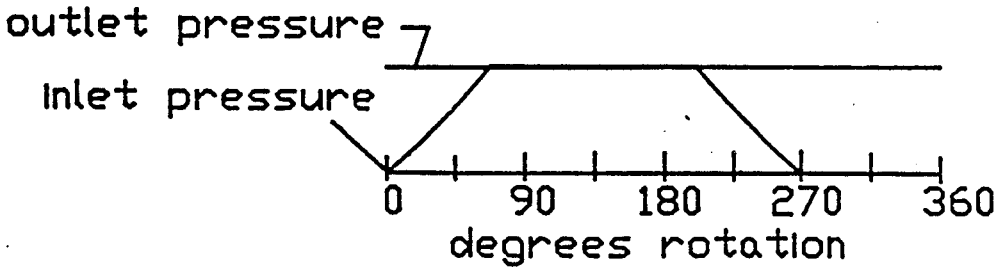
FIG. 5A represents a performance curve for compressor operating at an off-design point with FIG. 3 internal pressure control according to the invention.

FIG. 5 illustrates a pressure-position diagram with inlet control valve members 36 and outlet control valve members 37. By comparison of FIG. 4 with FIG. 5 it is obvious that FIG. 5 makes efficient use of input power. The same features that reduce wasted power also add application flexibility not previously available. For example: Assume the outlet pressure is a line at midpoint between the lines denoted inlet pressure and outlet pressure in FIG. 4. This condition, as illustrated in FIG. 4A results in very extreme excess power consumption as the internal pressure must still rise to the final peak before it can be discharged. Wasted power area 1 is greatly increased while wasted power area 2 in FIG. 4A remains about the same as wasted power area 2 in FIG. 4. Projecting the same condition onto FIG. 5A which incorporates inlet control valve members and outlet control valve members, simply shifts the point where discharge begins from approximately 110 degrees to approximately 65 degrees rotation but is free of the wasted power areas illustrated in FIG. 4A.

From the previous descriptions it should be obvious that there is a pressure difference between inlet passage 54 and outlet passage 55. Due to these pressure differences a lateral force is created in the direction of inlet passage 54. This force is approximately equal to ½ rotor 52 surface area times the differential pressure. Where the differential pressure is equal to the pressure at outlet passage 55 minus the pressure at inlet passage 54. FIG. 6 illustrates the longitudinal geometry of the prior art.

Figure 7:
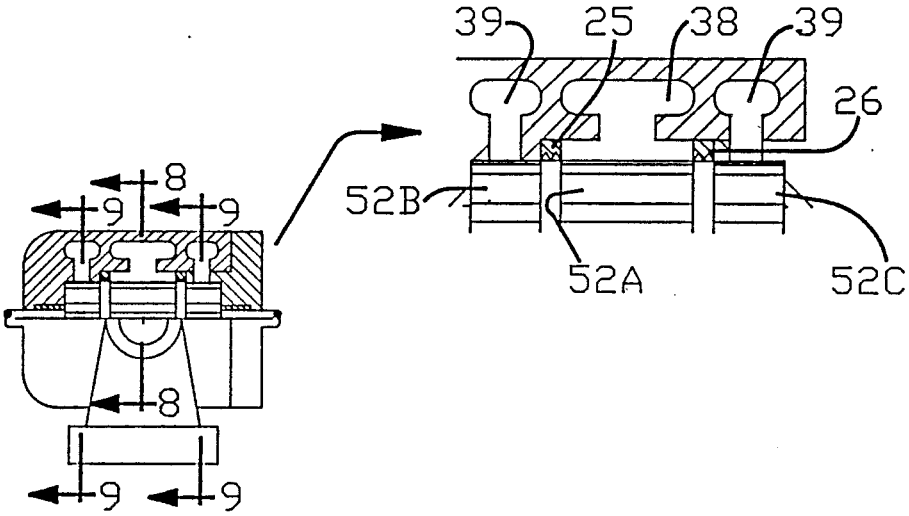
FIG. 7 is a longitudinal cross section showing the relationship of the three separate axial expansible chambers for radial thrust balancing according to the invention.
Figure 8:
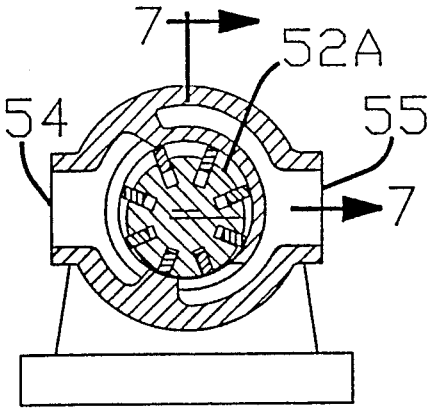
FIG. 8 is a transverse cross section of the center axial expansible chamber for radial thrust balancing according to the invention.
Figure 9:
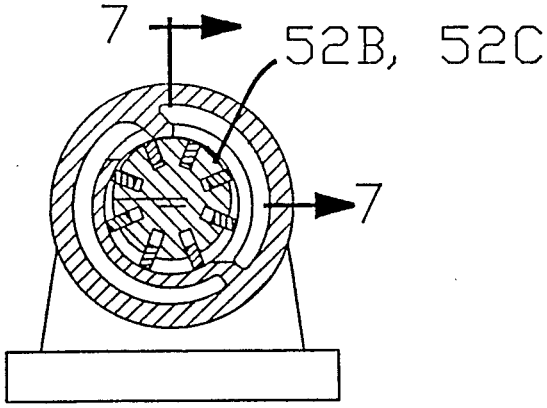
FIG. 9 is a transverse cross section of left and right axial expansible chambers for the radial thrust balancing according to the invention.
Figure 10:
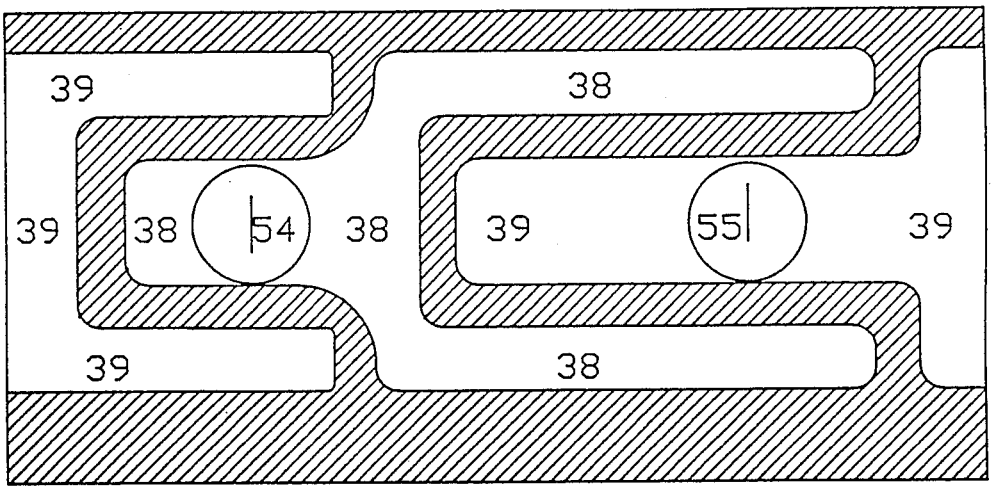
FIG. 10 is a cross sectional development through the gas passage illustrating one method of channeling gas to and from three separate expansible chambers illustrated in FIG. 7.
Figures 11, 12, 13:
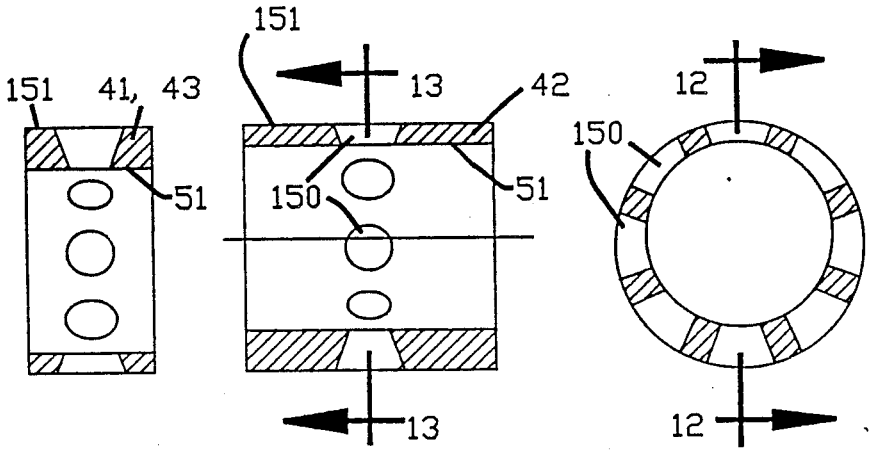
FIG. 11, FIG. 12 and FIG. 13 are various cross sectional views of the cylinder liner that clearly illustrate offset bores.

FIG. 7 represents another embodiment of the present invention and illustrates a longitudinal geometry comprising a rotor 52 constructed in such a manner that it is of three sections 52A, 52B, and 52C instead of one section and the three sections are isolated from each other by addition of rotor seal members 25 and 26. In this example the longitudinal length of 52B and 52C are each ½ the length of 52A. Interior surface 51 bore eccentricity for rotor section 52A is as shown on FIG. 8 and FIG. 6. Interior surface 51 bore eccentricity for rotor sections 52B and 52C are displaced 180 degrees from 52A. The relative positions are clearly illustrated in FIG. 8 and FIG. 9. (See also discussions relative to FIG. 11, FIG. 12 and FIG. 13). With the defined angular displacement of these sections and proper channeling of inlet passage 54 and outlet passage 55, compression and inlet events can occur simultaneously in all three sections. In this case, positive lateral forces are created in rotor section 52A while negative lateral forces are created in rotor sections 52B and 52C. With the length geometry previously defined, the sum of lateral forces equal zero. There are many ways to channel the inlet passage 54 and outlet passage 55 to accomplish the stated objective. FIG. 10 is one example. The same effect could also be accomplished by external piping. Similar principles can also be applied for a multistage compressor by changing the length relationships of the various rotor sections. In such a case, the channeling to the various rotor sections would ordinarily be accomplished by external piping. For example: Assume compression is to be conducted from 200 psig to 1000 psig in two stages. Although there are many solutions, one may be:

200 psig stage one inlet.
600 psig stage one outlet.
rotor section 52A 20 inch long.
600 psig stage two inlet.
1000 psig stage two outlet.
rotor sections 52B and 52C each 10 inch long.

The foregoing assumes equal diameters for rotor sections 52A, 52B and 52C. The stated objectives can also be accomplished by making rotor sections such that each section has a different diameter of equal or different lengths as desired, provided radial thrust loads are equal on rotor sections 52B and 52C and that the thrust load on rotor section 52A is equal to the summation of radial thrust loads on rotor sections 52B and 52C. Facilities to conveniently address this design and application flexibility are clearly illustrated in FIG. 11, FIG. 12 and FIG. 13. These drawings illustrate the detail of replaceable cylinder liner members 41, 42 and 43 included in the preferred embodiment FIG. 1. Cylinder liner members 41, 42 and 43 consist of liner ports 150, liner outside 151 and interior surface 51. Cylinder liner outside 151, slides into housing inside 152 with small clearance or slight interference fit. It is understood that cylinder liner ports 150 would not necessarily be as shown on the drawings and that quantity, size, location and configuration will depend upon interfacing components and gas flow paths to and from gas inlet passage 54 and gas outlet passage 55. There are several advantages to the use of replaceable cylinder liners. From a manufacturing and application standpoint there can be "standard" housing members 21 and closure members 22 and 23. In this case, special application requirements related to capacity can be built into the replaceable cylinder liners. This would also facilitate delivery by eliminating the need to obtain special patterns and castings for the major components (21, 22, 23). Interior surface 51 is one of the few wear areas. From the maintenance standpoint, replaceable cylinder liners will allow rebuild to new condition at minimal cost and time. Prior art seal elements vanes 53 are relatively fragile and have several limitations which include high bending and shear stress created by differential pressure over the area projecting between rotor 52 and cylinder 51 bore. The inherent cantilever bending also diminishes the seal area created between cylinder 51 bore and outermost tips of vanes 53. Another limitation is that pressure tends to lock the vane in the slot, causing sluggish outward movement. Another limitation is the friction heat caused by constant rubbing of contact surfaces especially those between interior surface 51 and tips of vanes 53. The depth of radial slots 64 result in time consuming precise machining, limited methods of fabrication and extremely heavy rotors 52 which are limited to relatively low rotating speeds. The ideal seal element should have better seal capabilities, be structurally sound, more position responsive, wear resistant and light weight. FIG. 2 and FIG. 14B show the existing design.

Figure 14:
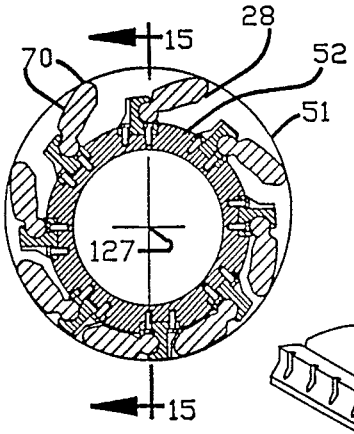
FIG. 14 is a transverse cross section illustrating the articulated volume displacer according to the invention.
Figure 15:
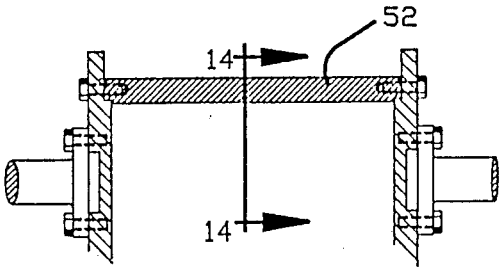
FIG. 15 is a longitudinal cross section illustrating one method of light weight rotor construction using the articulated volume displacer according to the invention.
Figure 16:
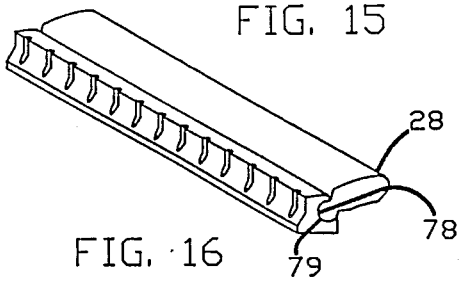
FIG. 16 is an isometric drawing of the articulated volume displacer according to the invention.
Figure 14B:
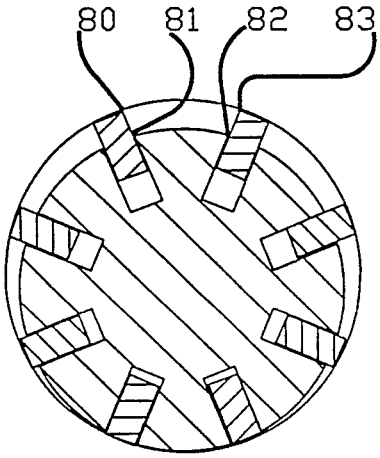
FIG. 14B is a partial transverse cross sectional drawing of prior art illustrating volume boundaries.

FIG. 14, FIG. 15 and FIG. 16 represent another embodiment of the present invention utilizing an articulated volume displacer concept meeting the ideal requirements. This concept consisting of rotor 52, rotor thrust surface 78, volume displacer thrust surface 79, volume displacer 28, outer contact surface 70. As rotor 52 turns clockwise about axis 127, volume displacer 28 rotates in a socket formed by rotor thrust surface 78 and volume displacer thrust surface 79 and outer contact surface 70 is forced outward by centrifugal force until it contacts interior surface 51.

This concept has the following advantages:

1. The outer configuration of the volume displacer 28 can be such that the contact surface 70 is constantly changing as rotor 52 moves from maximum clearance (low pressure) to minimum clearance (high pressure). This is easily accomplished by setting the radius describing 70 to some value less than the radius describing 51. With this concept, any point along 70 is in contact with 51 for only a small period of time during each revolution of rotor 52. There is therefore more surface area to dissipate heat and less time at any friction point on surface 70 to generate heat. The ability to dissipate heat more effectively and reduce heat concentration prolongs the wear life of volume displacer 28.

2. The articulated volume displacer allows a reduced section rotor 52 with a relatively large inside diameter as shown in FIG. 14 and FIG. 15. This is desirable to minimize rotating weight and reduce rotor manufacturing cost.

Figure 14A:
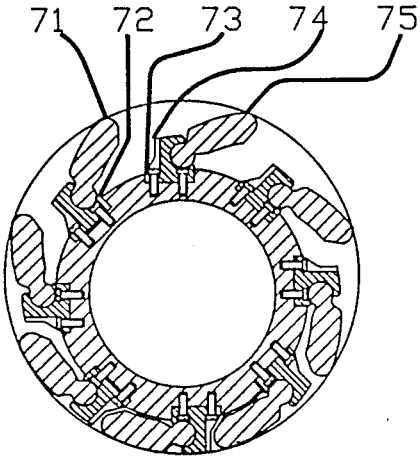
FIG. 14A is a partial transverse cross sectional drawing illustrating volume boundaries according to the invention.

3. The volumetric efficiency (pumping capacity) is a function of the amount of gas ingested just prior to the time compression begins. Inspection of FIG. 14A (present invention) and FIG. 14B (prior art) reveals the area bounded by 71, 72, 73, 74 and 75 in FIG. 14A exceeds the area bounded by 80, 81, 82 and 83 in FIG. 14B by at least fifty percent. Therefore, for the same interior surface 51 bore and rotor 52 diameter, the capacity per revolution of the present invention exceeds the capacity of the prior art by at least fifty percent.

Figure 17:
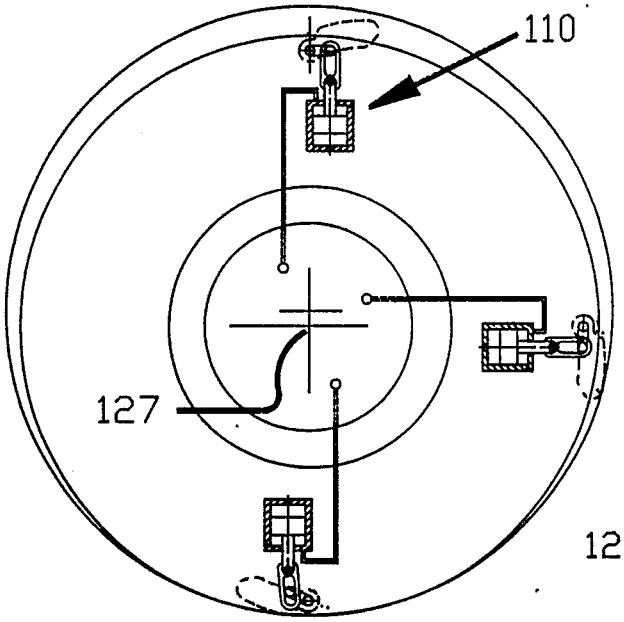
FIG. 17 is an end view illustrating a method for positioning the articulated volume displacer for capacity control according to the invention.
Figure 17A:
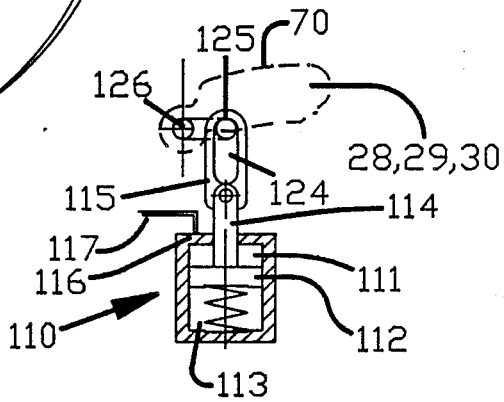

4. In many compressor applications it is desirable to have the capability to vary capacity over large ranges. The articulated volume displacer concept of FIG. 14, FIG. 15 and FIG. 16 can be easily modified to vary capacity from 0 to 100%. A method to accomplish this objective is clearly illustrated in FIG. 17 and FIG. 18. Referring to FIG. 17, there is shown three positions for one volume displacer 28, 29 or 30. Further reference will be to 28 however it will be understood that reference to 28 will apply equally to 29 and 30. The various included components in this illustration are loading cylinder 110 comprised of bore 111, piston 112, loading spring 113 and rod 114. Loading cylinder 110 is firmly affixed to rotor end 123. Rod 114 is firmly affixed to piston 12 which is slideable in bore 111. Link 115 is loosely affixed to rod 114 so that it can rotate clockwise or counterclockwise several degrees. Crank end 125 engages and is slideable in link slot 124. Crank 122 extends through rotor end 123 and is firmly affixed to volume displacer 28 such that any movement of crank 122 results in equal movement of volume displacer 28 and vice versa. Loading cylinder 110 has a control media connection 116 to which is firmly affixed a control media communication line 117 which is in turn firmly affixed to control media communication chamber 118.

Figure 18:
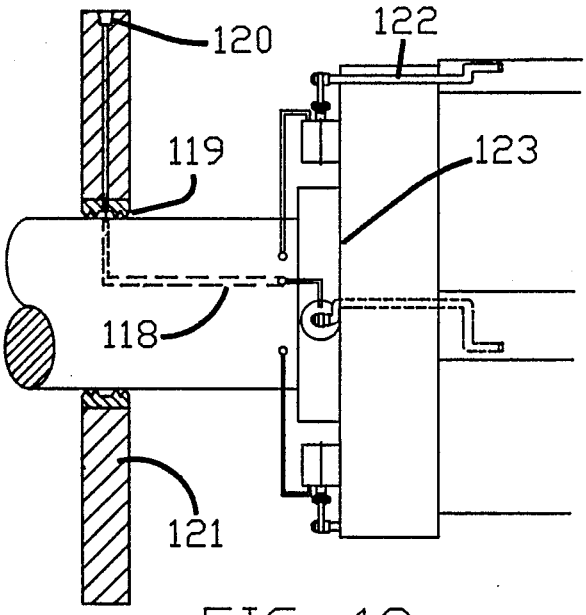
FIG. 18 is a side view illustrating a method for positioning the articulated volume displacer for capacity control according to the invention.

Operation of the rotary compressor capacity control according to the invention is as follows:

FIG. 18 clearly shows one method of introducing an external control pressure to the control media communication chamber. Stationary structure housing 121 is fitted with labyrinth or other suitable control media isolation seals 119 and control port 120 which receives a pressure signal from an external pressure source.

When a control media fluid pressure is received at control media communication chamber 118 it is transmitted to control media connection 116 through control media communication line 117. As pressure is increased within bore 111, piston 112 is moved in a direction opposite the applied pressure and compresses loading spring 113. The magnitude of compression of the loading spring depends upon the control media pressure. As control media pressure increases, piston 112 moves a greater distance which in turn moves rod 114 pulling link 115. After sufficient movement of piston 112, link 115 will traverse to the point where crank end 125 is at the end of link slot 124 and any further increase in control media pressure will result in crank 112 rotating about axis 126 which causes volume displacer 28 to be pulled inward thus preventing contact between outer contact surface 70 and interior surface 51 thereby preventing compression of gas for the rotating interval while surfaces 70 and 51 are not in contact. In order to clearly illustrate the concept FIG. 17 shows three positions for one volume displacer 28. At the top sufficient control media pressure has been applied to deflect outer contact surface 70 away from interior surface 51 by a considerable amount. As volume displacer 28 rotates clockwise about rotor axis 127, the gap between outer contact surface 70 and interior surface 51 is diminished. After approximately 90 degrees the said gap no longer exists and gas compression will begin. This condition will repeat with each revolution until the control media pressure is increased or reduced. Increasing control media pressure will prevent gas compression for a longer period and reducing control media pressure will allow compression over a longer period.

What I claim is:

1. An improved rotary gas compression apparatus comprising a singular housing having a substantially cylindrical inside surface to provide a closed working chamber, said working chamber having three expansible chambers each substantially isolated from the other, each said expansible chamber having a cylinder liner substantially cylindrical on the outside and interior with the said interior axis eccentric to the axis of said housing inside surface and said cylinder liner outside surface, said housing and said cylinder liners having inlet and outlet ports communicating with said cylinder liner said interior surface, a rotor mounted in said expansible chambers and rotatable about an axis eccentric to the axis of said cylinder liner interior surfaces, said rotor having a plurality of articulated volume displacers mounted on said rotor periphery slidably engaging said cylinder liner said interior surfaces, said volume displacers have actuators mounted on at least one end of said rotor for control of duration of slidable engagement with said cylinder liner said interior surfaces;

a. said housing having one or more one way automatic pressure actuated gas inlet control valves in the communication path to each said expansible chamber for enabling inlet gas flow into said expansible chamber whenever pressure on the inlet side of said inlet control valve is equal to or greater than pressure in said expansible chamber while inhibiting gas flow from said expansible chamber in the direction of said inlet gas source whenever said gas pressure within said expansible chamber is substantially greater than pressure on said inlet side of said control valve, b. said housing having one or more one way automatic pressure actuated gas outlet control valves in the communication path from each said expansible chamber for enabling outlet gas flow from said expansible chamber whenever pressure on the outlet side of said outlet control valve is substantially less than pressure in said expansible chamber while inhibiting gas flow from said outlet side of said outlet control valve in the direction of said expansible chamber whenever gas pressure on said outlet side of said outlet control valve is substantially greater than pressure on said inlet side of said outlet control valve.

2. A rotary compression apparatus according to claim 1 wherein at least one said cylinder liner is integral with said housing.

3. A rotary compression apparatus according to claim 2 wherein at least two said expansible chambers have separate communicating paths to external connections to allow gas exiting from one lower pressure said expansible chamber to be cooled or otherwise processed by external equipment before being returned for further compression in another said expansible chamber.

4. An improved rotary gas compression apparatus comprising a housing having a substantially cylindrical inside surface to provide a closed working chamber, said working chamber having one or more expansible chambers each substantially isolated from the other, each said expansible chamber having a substantially cylindrical interior surface, at least one inlet port and at least one outlet port communicating from said housing to said interior surface, a rotor mounted in said expansible chamber and rotatable about an axis eccentric to the axis of said interior surfaces, said rotor having a plurality of articulated volume displacers slidably engaging said interior surfaces on one end and outer surface and the other end pivoted in an arcuate socket formed in a stancion, said stancion being mechanically fastened at or near said rotor outside diameter for ease of maintenance or replacement.

5. A rotary compression apparatus according to claim 4 wherein said movable members are articulated volume displacers mounted on said rotor periphery and said volume displacers have external means for control of duration of engagement with said cylinder liner said interior surfaces.

6. A rotary compression apparatus according to claim 4 wherein said housing is provided with at least one cylinder liner substantially cylindrical on the outside and interior with the said interior axis eccentric to the axis of said housing inside surface and said cylinder liner outside surface, said housing and said cylinder liner having inlet and outlet ports communicating with said cylinder liner said interior surface.

7. A rotary compression apparatus according to claim 4 wherein said housing is provided with a common inlet chamber cooperating with said two or more said expansible chambers.

8. A rotary compression apparatus according to claim 4 wherein said housing is provided with a common outlet chamber cooperating with said two or more said expansible chambers.

9. A rotary compression apparatus according to claim 4 wherein at least two said expansible chambers have separate communicating paths to external connections to allow gas exiting from one lower pressure said expansible chamber to be cooled or otherwise processed by external equipment before being returned for further compression in another said expansible chamber.

10. A rotary compression apparatus according to claim 4 wherein said housing is provided with one or more one way automatic pressure actuated gas inlet control valves in the communication path to each said expansible chamber for enabling inlet gas flow into said expansible chamber whenever pressure on the inlet side of said inlet control valve is equal to or greater than pressure in said expansible chamber while inhibiting gas flow from said expansible chamber in the direction of said inlet gas source whenever said gas pressure within said expansible chamber is substantially greater than pressure on said inlet side of said control valve.

11. A rotary compression apparatus according to claim 4 wherein said housing is provided with one or more one way automatic pressure actuated gas outlet control valves in the communication path from each said expansible chamber for enabling outlet gas flow from said expansible chamber whenever pressure on the outlet side of said outlet control valve is substantially less than pressure in said expansible chamber while inhibiting gas flow from said outlet side of said outlet control valve in the direction of said expansible chamber whenever gas pressure on said outlet side of said outlet control valve is substantially greater than pressure on said inlet side of said outlet control valve.

* * * * *